United States Patent [19]

Griffin

[11] 3,996,434

[45] Dec. 7, 1976

[54] HOUSEHOLD FREEZER DOOR ALARM SWITCH HAVING AN AUTOMATIC RESETTING DEACTIVATOR

[75] Inventor: James R. Griffin, Louisville, Ky.

[73] Assignee: General Electric Company, Louisville, Ky.

[22] Filed: Apr. 23, 1975

[21] Appl. No.: 570,737

[52] U.S. Cl. ..... 200/61.79; 200/61.82; 200/318

[51] Int. Cl.[2] ..... H01H 3/20; H01H 9/20

[58] Field of Search ..... 200/61.76–61.82, 200/318, 321, 323, 324, 325, 327, 328, 333, 334, 336, 338, 339, 340, 295, 322; 62/130

[56] References Cited

UNITED STATES PATENTS

| | | | |
|---|---|---|---|
| 2,238,630 | 4/1941 | De Reamer | 200/61.82 |
| 2,484,424 | 10/1949 | Rosing | 200/321 X |
| 2,523,125 | 9/1950 | Ley | 200/61.79 |
| 2,592,660 | 4/1952 | Crumley | 200/61.82 X |
| 2,810,061 | 10/1957 | Serrone | 200/61.82 X |
| 2,828,378 | 3/1958 | Rumsey | 200/61.79 |
| 2,856,477 | 10/1958 | Schultz | 200/61.79 |
| 3,504,372 | 3/1970 | Sharples | 200/318 X |
| 3,691,325 | 9/1972 | Bognar | 200/295 X |
| 3,694,595 | 9/1972 | Horecky | 200/61.76 |

*Primary Examiner*—James R. Scott
*Attorney, Agent, or Firm*—Francis H. Boos

[57] ABSTRACT

A household freezer alarm system has a door alarm switch having a holding element that is movable to a position for releasably maintaining an actuating plunger of the switch at a deactivated position. At the deactivated position, the freezer can be cleaned, loaded with food, or other freezer door-open operations performed without sounding a door-open alarm. Means is associated with the holding element for automatically moving the holding element from the holding postion to the free position in response to closing the position door for automatically resetting the alarm system.

4 Claims, 5 Drawing Figures

HOUSEHOLD FREEZER DOOR ALARM SWITCH HAVING AN AUTOMATIC RESETTING DEACTIVATOR

BACKGROUND OF THE INVENTION

Household freezers have become generally commonplace in the homes of individuals who desire to have relatively large volumes of food readily available. These food supplies are maintained in the household freezer at below-freezing temperatures for preventing spoilage.

One of the problems associated with these freezers was that the freezer door was sometimes accidentally left open which resulted in thawing and spoilage of the food. This often resulted in the loss of several hundred dollars worth of meat and vegetables.

In order to correct this problem, alarm systems were associated with the freezer and delivered a signal if the freezer door was left open. Delay devices were also associated with the alarm system which delayed actuation of the alarm for a preselected period of time. This permitted an individual to open the freezer door, retrieve a package of food and close the door without sounding of the door-open alarm.

However, these alarm systems generated another problem. For the user who needed to keep the freezer door open for extended periods of time for loading the freezer, cleaning the freezer, or performing other door-open operations, the sounding of the alarm while he performed these operations was exceedingly annoying.

In order to solve this problem, alarm system shutoff apparatus was provided. This permitted the user to deactivate the alarm system during periods when he expected to have the freezer door open for periods of time in excess of the alarm delay period.

These mechanical switches, as shown in the alarm systems of U.S. Pat. No. 3,100,383-Foster et al and U.S. Pat. No. 2,410,310-Smith et al, introduced an additional problem. Sometimes the user would mechanically deactivate the alarm system with the switch and then forget to reactivate the alarm system after he had finished his door-open operations. The user could subsequently fail to close the freezer door after recovering a food item and, since the alarm was deactivated by the switch, no alarm would be sounded to inform him of his mistake.

The invention therefore resides in an alarm system of a household freezer which is automatically reset in response to closing the door of the freezer.

SUMMARY OF THE INVENTION

In accordance with this invention, a household freezer has a door and a door-open alarm system which has a door-alarm switch. The switch has a housing and a plunger that is movably connected to the housing. The plunger is movable between a switch-open and a switch-closed position in response to respectively closing and opening the freezer door. A first electrical contact in connected to the housing and a second electrical contact is connected to and movable with the plunger. Means is provided for biasing the plunger to the switch-closed position for closing the electrical contacts and actuating the alarm system in response to opening the freezer door.

A holding element is movably connected to the housing for movement between a free position and a holding position. At the free position, the plunger is free to move between the switch-open and switch-closed position for operating the alarm system in response to closing and opening the freezer door. At the holding position, the holding element is contacting and releasably maintaining the plunger at a deactivated position between the switch-open and switch-closed positions. At the deactivated position of the plunger, the electrical contacts are spaced one from the other.

Means is associated with the holding element for automatically moving the holding element from the holding position to the free position in response to closing the freezer door for automatically resetting the alarm system.

Other aspects of the invention will be discovered by a study of the drawings.

DETAILED DESCRIPTION OF THE INVENTION

Figure 1:
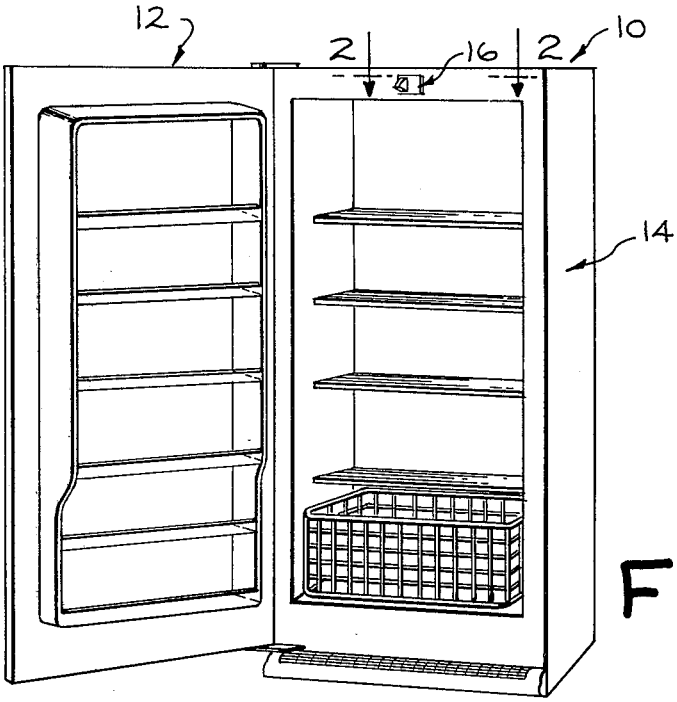
FIG. 1 is a perspective view of a household freezer having one embodiment of the door-alarm switch of this invention shown in the closed (plunger out) position.

In the embodiment of FIG. 1, a household freezer 10 has an access door 12 and a cabinet 14 forming a sealable food storage compartment. The freezer 10 also has a door-alarm system (not shown) which has a switch 16 mounted on the cabinet 14 and actuatable in response to opening and closing the door 12, as is known in the art.

As the door 12 of the freezer 10 is opened, a plunger of the switch 16 moves outwardly and electrical contacts are closed which actuates the alarm system. The alarm system may have a delay mechanism associated therewith for delaying the sounding of an alarm of the system for a preselected period of time, for example 30 seconds, after the door 12 is opened. As is further known, as the door 12 is closed, the plunger of the switch 16 is moved inwardly, thereby opening the electrical contacts and deactivating the alarm system. If the door 12 is closed prior to running of the delay time, the alarm is not sounded.

Figure 3:
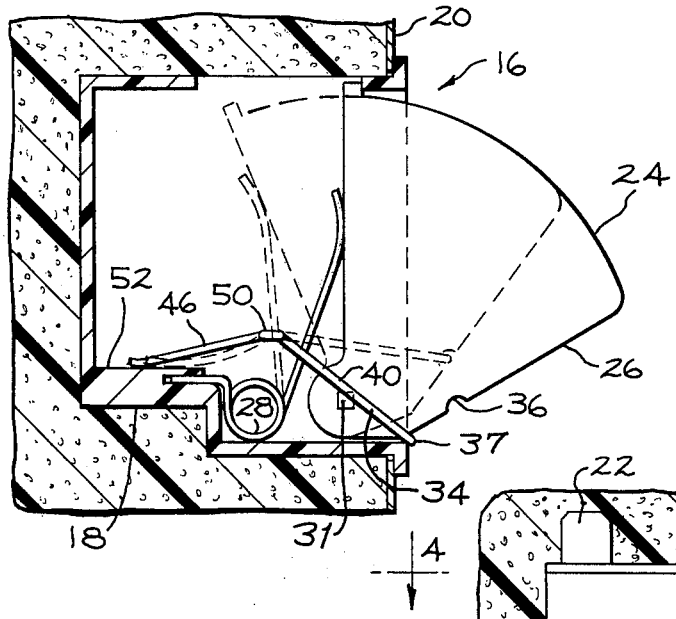
FIG. 3 is a sectional view taken along lines 3—3 of FIG. 2 showing a left side view of the switch.
Figure 2:
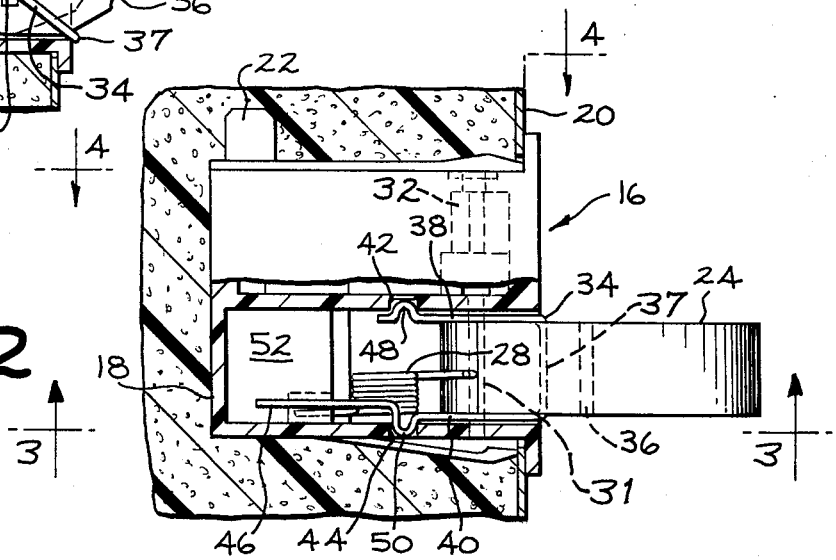
FIG. 2 is an enlarged sectional view taken along lines 2—2 of FIG. 1 showing a top view of the switch with a portion broken away to shown the internal arrangement.
Figure 4:
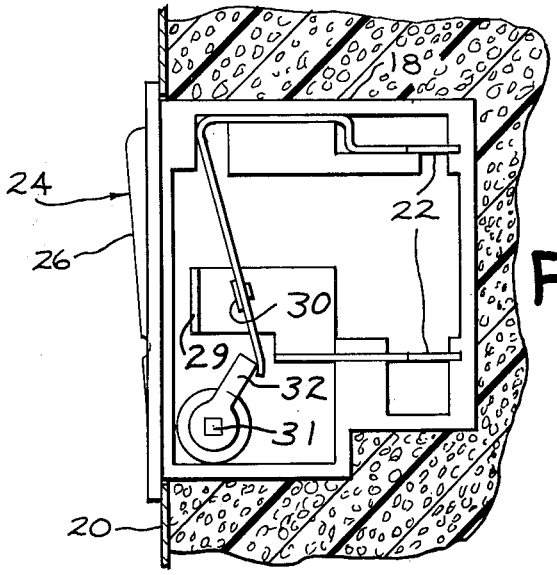
FIG. 4 is a sectional view taken along lines 4—4 of FIG. 2 showing a right side view of the switch with the switch in the open (plunger depressed) position.

In the embodiment of FIGS. 2–4, the switch 16 has a housing 18 that is connected to the face 20 of the freezer cabinet 14. In the installed position, an electrical plug 22 (FIG. 2) is connected to the alarm system, as is known in the art.

An example of the switch of this type is a rocker switch, Model No. 780102, manufactured by Littlefuse, Inc., which is located at 800 East Northwest Highway, Des Plaines, Illinois.

The switch 16 has a plunger 24 pivotally connected to the housing 18 for movement between a switch-closed position (FIGS. 1–3) at which the plunger 24 extends outwardly from the cabinet face 20 and a switch-open position (FIG. 4) at which a face 26 of the plunger 24 substantially lies in a plane of the cabinet face 20.

A biasing means 28, such as a spring, is associated with the housing 18 and the plunger 24 for biasing the plunger 24 to the switch-closed position, as shown by solid lines in FIG. 3.

The plunger 24 is at the switch-closed position in response to opening the freezer door 12. At this position, the alarm system is actuated. The plunger 24 is at the switch-open position in response to closing the cabinet door 12. At this position, as shown in FIG. 4, the alarm circuit is open in response to opening a pair of electrical contacts 29, 30 of the switch 16, the contact 29 being fixed and mounted to the switch housing 18 and the contact 30 being movable.

To provide an operative connection between the plunger 24 and the contacts 29, 30, a square shaft 31 passes through a corresponding square opening in the plunger 24 along the pivotal axis thereof and extends to the right and through a square opening in an arm member 32. When the plunger 24 is depressed, the shaft 31 rotates clockwise (viewed from the right side as in FIG. 4) and the arm member 32 moves the movable contact 30 away from the fixed contact 29.

The holding element 34, as best seen in FIG. 3, is formed of wire and is pivotally connected to the housing 18 for movement between a free position, shown by solid lines, and a holding position, shown by broken lines. At the free position of the holding element 34, the plunger 24 is free to move between the switch-open and switch-closed positions in response to closing and opening the freezer door 12. As shown, in the free position the holding element 34 is substantially entirely within the switch housing 18, thereby precluding any possibility of interference with the door 12 upon closing.

At the holding position, the holding element 34 is contacting and releasably maintaining the plunger 24 at a deactivated position, shown by broken lines in FIG. 3. At the deactivated position, the plunger is positioned between switch-open and switch-closed positions, the electrical contacts 29, 30 are spaced one from the other, and the alarm circuit is open.

The holding element 34 is mechanically movable by a user from the free position to the holding position when it is desirable that the alarm not sound during a period when the door is open.

The plunger 24 can be maintained at the deactivated position by frictional forces between the holding element 34 and the plunger face 26. In order to assure maintaining the plunger 24 at the deactivated position, it is preferred that a groove 36 be formed across the plunger face 26 at a position for receiving and releasably maintaining the holding element 34 in the groove 36. The groove 36 is configured to release the holding element 34 when the plunger 24 is further depressed toward the switch-open position, such as when the door 12 is closed.

Spring means is associated with the holding element 34, as will be hereafter more fully described, for biasing the holding element 34 from the holding position toward the free position for automatically resetting the alarm system in response to closing the freezer door 12.

The holding element 34 is of a generally "U" configuration, extends about the plunger 24, and has first and second legs 38, 40 positioned on opposed sides of the plunger 24, as better seen in FIG. 2. The "U" configured holding element 34 further includes a bight portion 37 (FIGS. 2 and 3) for engaging the groove 36. Each leg has outwardly extending protrusions 48, 50 for insertion into respective openings 42, 44 of the housing 18 for pivotally connecting the holding element 34 to the housing 18. It will be apparent that the pivotal connections of the protrusions 48, 50 to the openings 42, 44 are completely within the housing 18 and the entire arrangement and construction of the holding element 34 permits the holding element 34 to be substantially entirely within the housing 18 when in the free position, thereby precluding interference with normal closing of the door 12.

The means for biasing the holding element from the holding position toward the free position is a spring portion 46 which extends from one of the protrusions 50 and into contact with the housing 18.

Here the spring portion 46 extends into contact with ledge 52 of the housing 18. The ledge 52 maintains the spring portion 46 against downward movement during moving of the holding element to the holding position, thereby causing the element 34 to bend. The holding element 34 and/or the spring portion is resilient and thereby urges the holding element 34 from the holding position toward the free position.

It should be understood that the spring portion 46 can be a separate element, an extension of the holding element 34, or other biasing means. As shown in FIG. 3, the spring portion 46 is an extension of the holding element 34 which forms an acute angle with leg 40.

Figure 5:
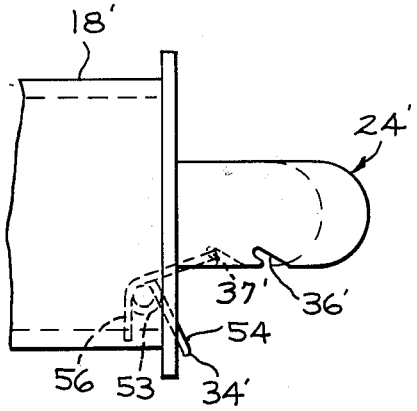
FIG. 5 is a side view of another embodiment of the switch of this invention.

In the embodiment of FIG. 5, the plunger 24' is slidably movable relative to the housing 18' as opposed to pivotally movable as in the embodiment of FIGS. 2–4. The apparatus of this embodiment functions in substantially the same manner as set forth above. However, in this embodiment, the spring portion of the holding element 34 is a helical spring 53 which has first and second legs 54, 56 and the groove 36' is formed on a side of plunger 24' for releasably receiving the holding element 34'.

In the operation of the apparatus of this invention, the alarm system is actuated each time the freezer door is opened and the alarm circuit is opened each time the freezer door is closed.

When a user desires to clean the freezer or perform a function which will require the door to remain open for a considerable length of time, the user manually depresses the plunger 24 to the deactuation position and inserts the bight portion 37 of the holding element 34 in the groove 36 for maintaining the electrical contacts 29, 30 spaced one from the other. At this position, the alarm system circuit is open. When the user is finished, the action of closing the freezer door causes the plunger 24 to be further depressed thereby freeing the holding element 34 which is biased to the free position.

By the use of the apparatus of this invention, the alarm system is manually deactivated and thereafter automatically reset in response to closing the freezer door. This apparatus, therefore, prevents a user from failing to reset the alarm system which could result in the loss of food where the freezer door is subsequently left open and the alarm system remains deactivated.

Other modifications and alterations of this invention will become apparent to those skilled in the art from the foregoing discussion, and it should be understood that this invention is not to be undully limited thereto.

What is claimed is:

1. In a household freezer having a door and a door-alarm system including a door-alarm switch, said switch having a housing, a plunger movably connected to the housing for movement between switch-open and switch-closed positions, a pair of electrical contacts arranged to open and close in response to inward and outward movement of the plunger resulting from closing and opening of the freezer door, the electrical contacts being connected to actuate the alarm system when the door is open and the plunger is in the switch-closed position and to deactivate the alarm system when the door is closed and the plunger is in the switch-open position, the improvement comprising:

a pair of opposed pivot openings on opposed inner walls of the housing;

a holding element of generally "U" configuration and having first and second legs pivotally connected within the housing to the housing for movement of the holding element between a free position at which the holding element is substantially within the housing to prevent interference with the door and at which the plunger is free to move between the switch-open and switch-closed positions, and a holding position at which the bight portion of the holding element contacts and releasbly maintains the plunger at a deactivated position between the switch-open and switch-closed positions and at which the electrical contacts are open, said holding element extending about the plunger and having an outwardly-extending protrusion on each leg with each protrusion pivotally positioned within a respective housing pivot opening;

a groove formed on said plunger for receiving and releasably maintaining the bight portion of the holding element at the holding position, said groove configured to release the holding element when the plunger is further depressed from the deactivated toward the switch-open position; and means within the housing for biasing the holding element from the holding position towards the free position;

whereby the holding element moves from the holding position to the free position in response to closing of the freezer door to automatically reset the alarm system.

2. A switch, as set forth in claim 1, wherein one of the holding element legs extends from its protrusion and into contact with the housing at a location sufficient for biasing the holding element from the holding position toward the free position.

3. A switch, as set forth in claim 1, wherein the plunger is pivotally connected to the housing.

4. A switch, as set forth in claim 1, wherein the plunger is slidably connected to the housing.

* * * * *